US007793650B2

(12) United States Patent
Nishio

(10) Patent No.: US 7,793,650 B2
(45) Date of Patent: Sep. 14, 2010

(54) OPEN/CLOSE DOOR DRIVE CONTROLLER FOR DRAWER-TYPE HEATING COOKER

(75) Inventor: Hirokazu Nishio, Izumi (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 6 days.

(21) Appl. No.: 11/939,658

(22) Filed: Nov. 14, 2007

(65) Prior Publication Data

US 2008/0288113 A1 Nov. 20, 2008

(30) Foreign Application Priority Data

Nov. 15, 2006 (JP) ..... 2006-308976

(51) Int. Cl.
*F23M 7/00* (2006.01)
*F24C 15/02* (2006.01)

(52) U.S. Cl. ..... 126/192; 126/190; 312/319.5; 318/2; 318/446; 318/591

(58) Field of Classification Search ..... 312/319.5; 219/403; 126/190, 192; 318/2, 446, 591
See application file for complete search history.

(56) References Cited

U.S. PATENT DOCUMENTS 4,697,661 A * 10/1987 Pajerski et al. ..... 180/6.5
4,733,314 A * 3/1988 Ogawa et al. ..... 360/99.07
4,999,551 A * 3/1991 Yoshida et al. ..... 318/286
5,329,075 A * 7/1994 Hirabayashi et al. ..... 187/316
5,497,084 A * 3/1996 Bicking ..... 324/207.25
5,746,282 A * 5/1998 Fujiwara et al. ..... 180/6.2
5,755,619 A * 5/1998 Matsumoto et al. ..... 463/19
6,003,627 A * 12/1999 Ishida ..... 180/206
6,208,102 B1 * 3/2001 Kikuchi et al. ..... 318/466
6,276,471 B1 * 8/2001 Kratzenberg et al. ..... 180/19.3
6,329,779 B1 * 12/2001 Pimley et al. ..... 318/445
6,560,515 B2 * 5/2003 Inoue ..... 701/22
7,078,662 B2 * 7/2006 Yoshidome ..... 219/756
7,414,225 B2 * 8/2008 Yoshidome et al. ..... 219/392
2003/0122459 A1 * 7/2003 Huber et al. ..... 312/319.6

(Continued)

FOREIGN PATENT DOCUMENTS

JP 64-22221 A 1/1989

(Continued)

*Primary Examiner*—Kenneth B Rinehart
*Assistant Examiner*—Jorge Pereiro
(74) *Attorney, Agent, or Firm*—Birch, Stewart, Kolasch & Birch, LLP

(57) ABSTRACT

When a user manually opens/closes the door of the drawer-type heating cooker, a pulse generation means attached to an electric motor generates pulses for counting the number of revolutions. A determination means determines whether the door is opened/closed manually or not on the basis of detection of the pulses. A prediction means predicts whether the manual operation is door opening or door closing in response to the status of position detection switches for detecting the position of the door. A motor control means decides the rotation direction of the electric motor in accordance with the prediction by the prediction means and controls the rotation of the electric motor on the basis of the decision. Hence the burden of door opening/closing operation is alleviated with the help of the driving force of the electric motor even when both hands of the user are occupied.

7 Claims, 9 Drawing Sheets

U.S. PATENT DOCUMENTS

| | | | | |
|---|---|---|---|---|
| 2005/0217923 | A1 * | 10/2005 | Onizuka et al. | 180/444 |
| 2006/0163239 | A1 * | 7/2006 | Yoshidome et al. | 219/392 |

FOREIGN PATENT DOCUMENTS

| | | | | |
|---|---|---|---|---|
| JP | 3-045820 | A | | 2/1991 |
| JP | 03072184 | A | * | 3/1991 |
| JP | 4-283463 | A | | 10/1992 |
| JP | 6-325461 | A | | 11/1994 |
| JP | 08117044 | A | * | 5/1996 |
| JP | 11093509 | A | * | 4/1999 |
| JP | 11-237053 | A | | 8/1999 |
| JP | 2002-367348 | A | | 12/2002 |
| JP | 2004225423 | A | * | 8/2004 |
| JP | 2005061032 | A | * | 3/2005 |
| JP | 2005-190546 | A | | 7/2005 |
| JP | 2005307643 | A | * | 11/2005 |
| JP | 2005315304 | A | * | 11/2005 |
| JP | 2006027483 | A | * | 2/2006 |
| JP | 2006028936 | A | * | 2/2006 |

* cited by examiner

FIG.5A POSITION DETECTION SWITCHES AND MANUAL OPENING/CLOSING OPERATION PREDICTIONS (DOOR FULL-CLOSED STATE)

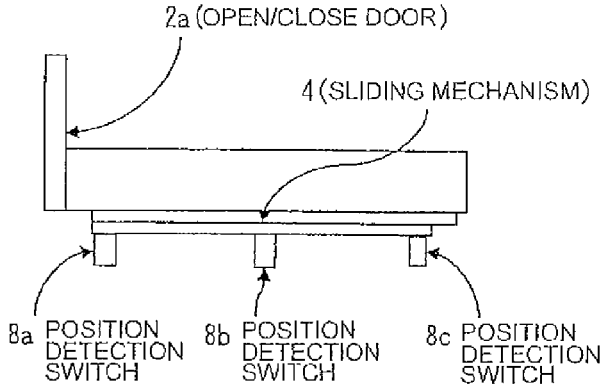

FIG.5B (DOOR FULL-OPEN STATE)

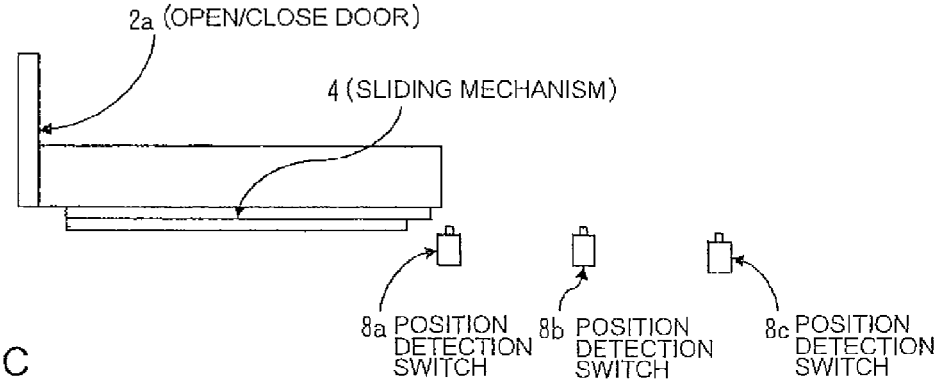

FIG.5C (PREDICTION OF USER OPERATION BASED ON DETECTION SWITCH STATUS)

| | | | | |
|---|---|---|---|---|
| DETECTION SWITCH 8a | ON | ON | ON | OFF |
| DETECTION SWITCH 8b | ON | ON | OFF | OFF |
| DETECTION SWITCH 8C | ON | OFF | OFF | OFF |
| | | | | |
| STATE OF DOOR | FULL-CLOSED | HALFWAY | HALFWAY | FULL-OPEN |
| | ⇩ | ⇩ | ⇩ | ⇩ |
| PREDICTION OF USER OPERATION | OPENING OPERATION | OPENING OPERATION | CLOSING OPERATION | CLOSING OPERATION |

FIG.5D (NAMES OF SWITCHES)

| | |
|---|---|
| POSITION DETECTION SWITCH 8a | DOOR-OPEN SWITCH |
| POSITION DETECTION SWITCH 8b | INTERMEDIATE SWITCH |
| POSITION DETECTION SWITCH 8c | DOOR-CLOSED SWITCH |

(EXAMPLE BASED ON HOLES)

(EXAMPLE BASED ON MAGNETS)

OPEN/CLOSE DOOR DRIVE CONTROLLER FOR DRAWER-TYPE HEATING COOKER

The present application is based on and claims priority of Japanese patent application No. 2006-308976 filed on Nov. 15, 2006, the entire contents of which are hereby incorporated by reference.

BACKGROUND OF THE INVENTION

1. Field of the Invention

This invention relates to a drawer-type heating cooker having a drawer-type cooking space (container), such as a microwave oven, and more particularly to decision on the driving direction of its open/close door and an open/close door drive controller based on the decision.

2. Description of the Related Art

Conventionally, as disclosed in Patent Document 1 (JP 3-045820A, page 2, lower left column, line 6 to page 3, upper right column, line 16, and FIG. 1 to FIG. 5) and Patent Document 2 (JP 11-237053A, paragraphs 0029 to 0032, and FIG. 1), there are proposals for a drawer-type heating cooker in which a drawer capable of mounting an object to be heated can be drawn out along with an open/close door from the cooker body, and the aperture of the heating chamber can be closed by the open/close door in the housed state where the drawer is housed in the heating chamber of the cooker body. The drawer-type heating cooker of this type includes a device body (cooker body) having a cooking chamber (heating chamber) for housing an object to be heated, an open/close door for blocking the cooking chamber from outside air, and a bottom plate, or a heating container (drawer) capable of mounting an object to be cooked, interlocked with the open/close door. More specifically, the bottom plate or the heating container is smoothly slid by a sliding mechanism, to which the rotational output of a motor is transmitted through a transmission means such as a rack-and-pinion mechanism, so that the bottom plate or the heating container can be drawn out from the device body or moved in the housing direction. When the bottom plate or the heating container is housed in the device body, the open/close door blocks the cooking chamber from outside air. The heating cooker disclosed in Patent Document 2 includes a heating container that can be drawn out from the cooker body. An aperture is formed on top of the heating container, and is covered with a lid to form a heating chamber for confining microwaves. A choke groove is provided between the aperture periphery and the lid of the heating container to prevent leakage of radio waves.

However, automatic drawer-type opening/closing in conventional drawer-type heating cookers is realized only by automatic opening/closing based on operation of a keypad disposed on the body or the open/close door of the heating cooker. Furthermore, when the open/close door is manipulated by manual opening/closing, the drawer is also moved with the open/close door. However, automatic opening/closing interlocked with manual opening/closing has not been realized.

Patent Document 3 (JP 2005-190546A, paragraphs 0055 to 0063) discloses an audio-visual device such as a video tape recorder or a video disk player in which a tray for holding a recording medium is transported by a transporting apparatus. When a user manually pushes the tray by a certain amount, a detection switch is triggered, and the transporting apparatus draws the tray into the device by a drive motor. A rotational force insufficient for activating the transporting apparatus is applied to the drive motor in advance, and the user's manual operation is immediately assisted by the rotational force of the drive motor to reduce the user's labor. However, the action of assisting the user's manual operation by the transporting apparatus is limited to the action of drawing the tray into the device.

In the heating cooker, the portion moving with opening/closing has significantly large mass than that in the audio-visual device. Hence the drive mechanism in the heating cooker is greatly different in configuration from that in the transporting apparatus of the audio-visual device. Furthermore, the heating cooker needs automatic opening/closing interlocked with manual opening/closing of the open/close door in both directions. Therefore it is extremely difficult to realize automatic opening/closing interlocked with manual opening/closing by applying the transporting apparatus disclosed in Patent Document 3 to a drawer-type heating cooker.

When both hands of a user are occupied with an object to be cooked such as a food item, it is virtually difficult to operate keys provided on the body or the open/close door of the cooker. In such situations, the user tries to close the open/close door with any part of the user's body. However, if the user does not know how to operate the keypad, or if the keypad is faulty, the user is forced to manually open/close the door.

Thus there is a problem to be solved with the automatic open/close door of a drawer-type heating cooker. More specifically, when a user performs manual opening/closing operation, irrespective of the direction of the manual operation of the open/close door, it is desirable to cause a drive means for door opening/closing to start automatic opening/closing of the door in that direction, thereby alleviating the burden of manual opening/closing of the door.

SUMMARY OF THE INVENTION

An object of this invention is to provide a drawer-type heating cooker that, upon user's manual opening/closing operation in the door opening or door closing direction, causes a drive means for door opening/closing to start automatic opening/closing operation in that direction, thereby providing high convenience even when both hands of the user are occupied.

To solve the above problems, this invention provides an open/close door drive controller in a drawer-type heating cooker, the drawer-type heating cooker including a cooker body with a heating chamber formed therein, a drawer that can be drawn out from and housed in the heating chamber and integrally has an open/close door capable of closing an aperture of the heating chamber when the drawer is housed, and a drive unit for driving the drawer. The open/close door drive controller comprises determination means for determining whether the open/close door is manually opened/closed; and drive unit control means for controlling the drive unit, wherein in response to determination by the determination means that the open/close door is manually operated, the drive unit control means causes the drive unit to open/close the open/close door in accordance with manual opening/closing direction.

In this open/close door drive controller in a drawer-type heating cooker, when a user manually opens or closes the door, the determination means determines that the door is manually opened/closed. The drive unit control means decides the driving direction of the drive unit and controls the drive unit on the basis of the decision. By this control, when a user manually opens/closes the open/close door, it is determined whether the moving direction of the door is the opening direction or the closing direction, and in either direction, the open/close door can be automatically opened/closed in that direction by the action of the drive unit.

In this open/close door drive controller in a drawer-type heating cooker, the drive unit may be an electric motor, the drive unit may be driven in a driving direction that is a rotation direction of output rotation of the electric motor, the rotation direction corresponding to the opening/closing direction of the open/close door, and the drive unit control means may be electric motor control means for controlling the rotation of the electric motor. When an electric motor is used as the drive unit, the output rotation of the drive motor is transformed to the opening/closing action of the open/close door by a suitable mechanism. The rotation direction of the electric motor corresponds to the opening/closing direction of the open/close door, and the electric motor control means serving as the drive unit control means controls the rotation of the electric motor.

The open/close door drive controller in a drawer-type heating cooker with the drive unit being an electric motor may further comprises pulse generation means for generating pulses for counting the number of revolutions of the electric motor, the pulse generation means being attached to the electric motor; and prediction means, responsive to a status of a position detection switch for detecting position of the open/close door, for predicting whether the operation of the open/close door is door opening or door closing, wherein in response to detection of the pulses generated by the pulse generation means, the determination means determines whether the open/close door is manually opened/closed, and in response to the determination of manual operation by the determination means, the electric motor control means decides the rotation direction of the electric motor in accordance with the prediction by the prediction means and controls the rotation of the electric motor based on the decision. In this open/close door drive controller, when a user manually opens/closes the open/close door, revolution counting pulses are generated from the electric motor despite that no rotation command is issued to the electric motor. On the basis of detection of the pulses, the determination means determines whether the door is manually opened/closed. Furthermore, on the basis of the status of the position detection switch for detecting the position of the door, the prediction means predicts whether the manual operation of the door is door opening or door closing. The motor control means decides the rotation direction of the electric motor in accordance with the prediction by the prediction means and controls the rotation of the motor on the basis of the decision. By this control sequence, when a user manually opens/closes the open/close door, it is detected whether the moving direction of the open/close door is the opening direction or the closing direction, and in either direction, the open/close door can be automatically opened/closed in that direction.

The open/close door drive controller in a drawer-type heating cooker with the drive unit being an electric motor may further comprises pulse generation means for generating pulses for counting the number of revolutions of the electric motor, the pulse generation means being attached to the electric motor; and gear rotation direction detection means for detecting rotation direction of a gear that transmits the output of the electric motor to open/close the open/close door, wherein in response to detection of the pulses generated by the pulse generation means, the determination means determines whether the open/close door is manually opened/closed, and in response to the determination of manual operation by the determination means, the electric motor control means decides the rotation direction of the electric motor in accordance with a detection result of the gear rotation direction detection means and controls the rotation of the electric motor based on the decision. In this open/close door drive controller, when a user manually opens/closes the open/close door, revolution counting pulses are generated from the electric motor despite that no rotation command is issued to the electric motor. On the basis of detection of the pulses, the determination means determines whether the open/close door is manually opened/closed. Furthermore, when the determination means determines that the open/close door is manually operated, the rotation direction of a gear that transmits the output of the electric motor to open/close the open/close door is detected by the gear rotation direction detection means. Thus it is detected whether the manual operating direction of the door is the door opening direction or the door closing direction. The electric motor control means decides the rotation direction of the electric motor in accordance with the detection by the gear rotation direction detection means and controls the rotation of the electric motor on the basis of the decision. By this control sequence, when a user manually opens/closes the door, it is detected whether the moving direction of the door is the opening direction or the closing direction, and in either direction, the door can be automatically opened/closed in that direction.

In this open/close door drive controller in a drawer-type heating cooker including the gear rotation direction detection means, the gear rotation direction detection means may include a magnet embedded in the gear and a Hall element capable of detecting passage of the magnet. For example, in the case with a plurality of magnets for one Hall element, the rotation direction can be found if the magnets can be identified by detected signals. Conversely, in the case with one magnet, the rotation direction can be found by the order of detections by a plurality of Hall elements.

In this open/close door drive controller in a drawer-type heating cooker including the gear rotation direction detection means, the gear rotation direction detection means may include a photosensor and a light emitting element that are disposed to sandwich the gear there between, and the photosensor can detect light emitted from the light emitting element when the photosensor is opposed to the light emitting element through a hole formed in the gear. Specific detection of rotation direction is similar to those used for Hall elements and magnets.

The open/close door drive controller in a drawer-type heating cooker including the pulse generation means may further comprise pulse count normality determination means for determining whether the number of pulses is the number that is assumed to be normal when the electric motor is rotating in the rotation direction decided by the electric motor control means, wherein in response to determination by the pulse count normality determination means that the number of pulses is not normal, the electric motor control means determines that the decided rotation direction of the electric motor does not match the actual rotation direction of the electric motor due to manual opening/closing of the open/close door, redecides the decided rotation direction to be reverse rotation direction, and controls the rotation of the electric motor based on the redecided rotation direction. More specifically, when a user manually opens/closes the door while the electric motor is energized, the direction of user's operation does not necessarily match the rotation direction of the electric motor decided by the electric motor control means.

When the number of pulses actually generated by the pulse generation means is different from the normal pulse counts for rotation of the motor in the rotation direction decided by the electric motor control means, it is determined that, due to manual opening/closing of the open/close door, the actual rotation direction of the electric motor does not match the rotation direction of the electric motor decided by the control circuit. The control circuit then reverses the rotation direction of the electric motor to rotate the motor in accordance with the rotation direction by manual operation. In other words, when the number of pulses actually generated matches the normal pulse counts, the rotation direction of the electric motor decided by the motor control means is left unchanged. However, particularly in the case of using the prediction means, when the prediction of the door operating direction by the prediction means is wrong, an abnormality occurs where the electric motor is forced to rotate in the direction opposite to the manual operation and nearly falls into the lock state. Hence the number of pulses generated from the motor fails to be the normal pulse count. By reading it, control on the motor rotation direction can be changed.

The open/close door drive controller in a drawer-type heating cooker according to this invention is configured as described above. Hence, if a user slightly moves the open/close door in the opening or closing direction when both hands of the user are occupied with a food item or other object, the moving direction of the open/close door at that time is detected, and the door can be opened/closed without keypad operation. Furthermore, even in the case where the keypad is faulty, when the user manually opens/closes the door, an initial light operating force is sufficient to open/close the open/close door with the help of the driving force of the motor. Thus the manual opening/closing of the door is assisted by an automatic opening/closing means or completely switched to its automatic opening/closing, alleviating the burden of door opening/closing manually initiated by the user.

BRIEF DESCRIPTION OF THE DRAWINGS

FIG. 5 illustrates the correspondence between position detection switches and manual opening/closing operation predictions for the drawer-type heating cooker according to this invention.

DETAILED DESCRIPTION OF THE PREFERRED EMBODIMENTS

Figure 1:
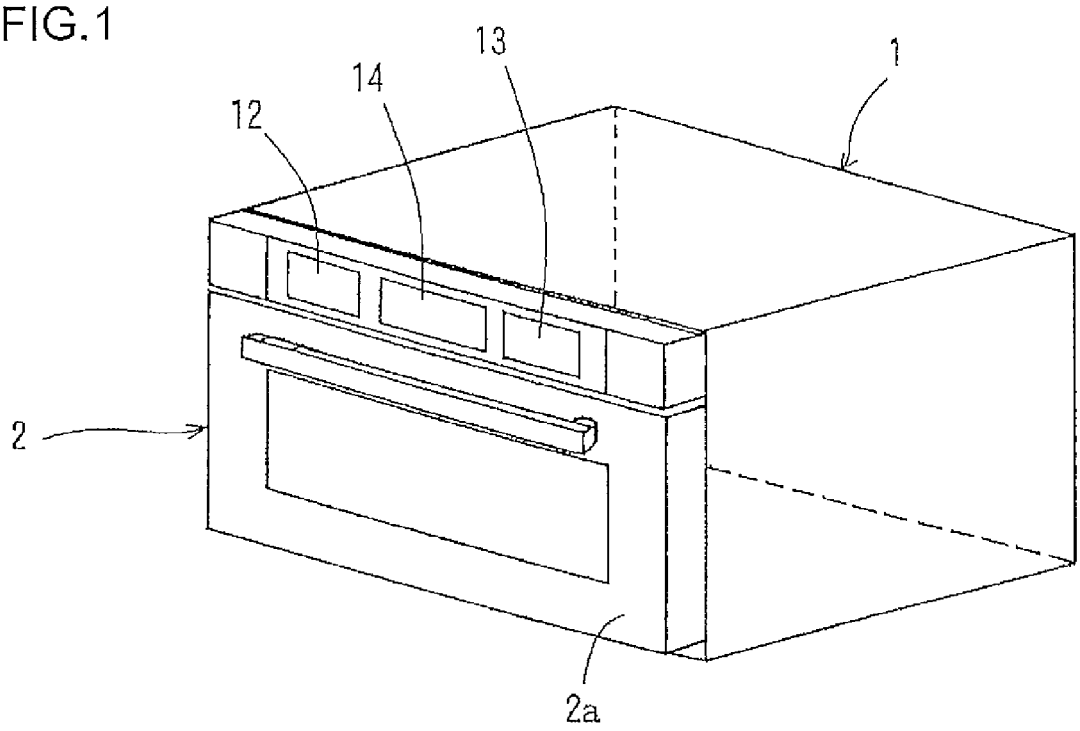
FIG. 1 is a perspective view of an embodiment of the drawer-type heating cooker to which an open/close door drive controller according to this invention is applied, shown in the closed state of the open/close door.
Figure 2:
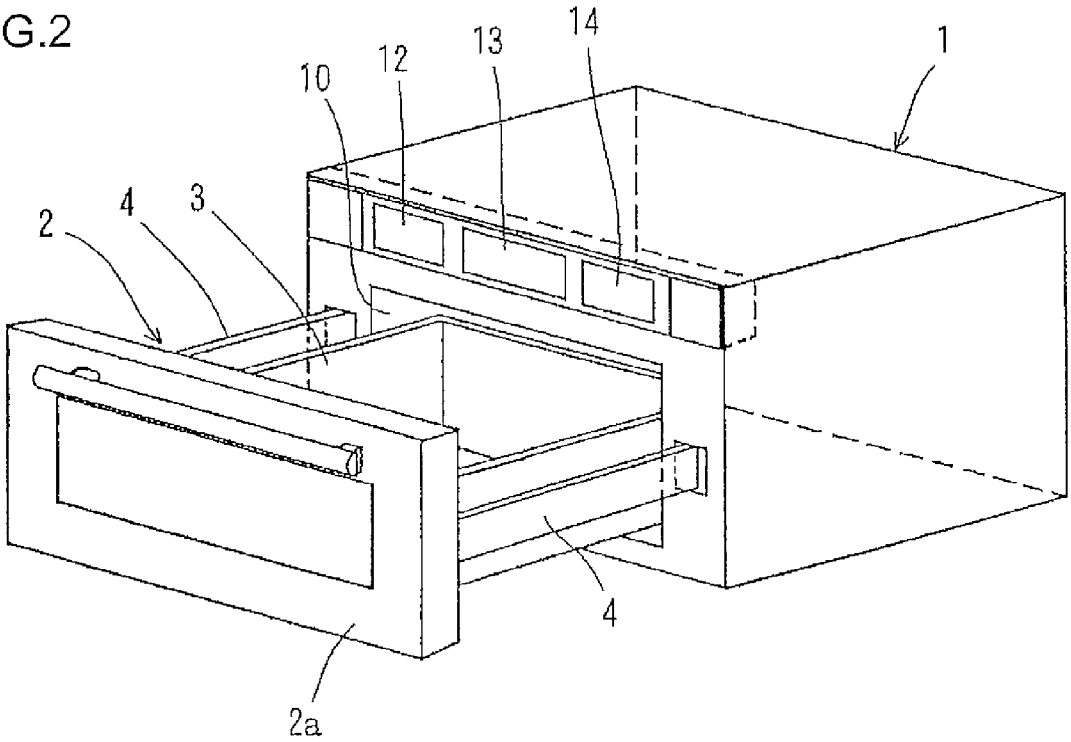
FIG. 2 is a perspective view of the drawer-type heating cooker of FIG. 1, shown in the opened state of the open/close door.
Figure 3:
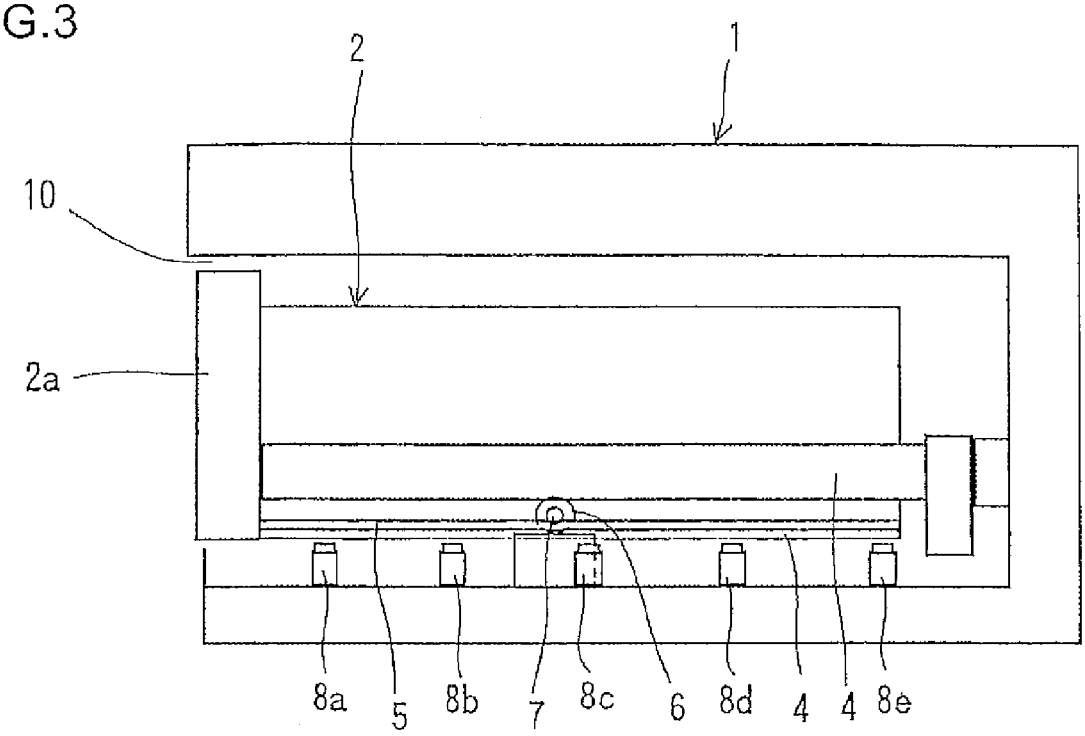
FIG. 3 is a side cross-sectional view of the drawer-type heating cooker of FIG. 1.

An embodiment of the open/close door drive controller in a drawer-type heating cooker according to this invention will now be described with reference to the attached drawings. FIG. 1 is a perspective view of an embodiment of the drawer-type heating cooker to which an open/close door drive controller according to this invention is applied, shown in the closed state of the open/close door. FIG. 2 is a perspective view of the drawer-type heating cooker of FIG. 1, shown in the opened state of the open/close door. FIG. 3 is a side cross-sectional view of the drawer-type heating cooker of FIG. 1.

As shown in FIGS. 1 and 2, the drawer-type heating cooker (herein after simply abbreviated as "heating cooker") includes a cooker body 1 and a drawer 2 that can be drawn out from the cooker body 1. The cooker body 1 has therein a heating chamber into which the drawer 2 for mounting an object to be cooked can be moved. The heating chamber is surrounded inside by walls on its left, right, top, bottom, and rear side, but its front side is formed as an aperture for entry and exit of the drawer 2.

The drawer 2 is movably disposed in the cooker body 1 using a sliding mechanism 4 described later so that the drawer 2 can be drawn out from the heating chamber of the cooker body 1 in the direction shown by the arrow or, conversely, can be closed from outside. The drawer 2 includes an open/close door (herein after abbreviated as "door") 2*a* for opening/closing the heating chamber and a heating container 3 with the door 2*a* attached thereto for receiving an object to be heated in the mounted state. The heating container 3 includes a front plate attached to the door 2*a*, a left and right side plate extending rearward from the left and right side of the front plate, a rear plate connected to the side plates on their rear side, and a bottom plate connected to the side plates and the rear plate, and a container aperture for entry and exit of an object to be heated is formed on top of the heating container 3. Although not shown, inside the cooker body 1 is installed a microwave generator that is composed of a magnetron for generating a microwave and a waveguide propagating the microwave generated by the magnetron. The microwave generated in the magnetron is propagated in the waveguide and supplied through a feed port into the heating chamber.

The heating cooker includes sliding mechanisms 4, 4 disposed on both left and right outside of the heating container 3 and a sliding mechanism 4 disposed on the bottom side thereof (see FIG. 3) for moving the drawer 2 in the cooker body 1. Although not shown in detail, each sliding mechanism 4 is a nested mechanism of slide rails allowing a movable rail to slide relative to a fixed rail. The drawer 2 can be moved between a full-open position where the heating container 3 is completely drawn out from the heating chamber and a full-closed position where the heating container 3 is completely housed in the heating chamber. When the drawer 2 occupies the full-closed position, the door 2*a* closes the aperture 10 of the heating chamber. Hence the heating chamber is enclosed by the inner wall of the cooker body 1 and the drawer 2. The sliding mechanisms 4 are provided in the passage boxes formed in the cooker body 1 on the left, right, and bottom side of the heating chamber. The fixed rail is attached to the outside of the heating chamber in the passage box, and the movable rail can be moved into and out of the passage box along with the drawer 2. The drawer 2 is supported by the cooker body 1 through the sliding mechanisms 4 and can be stably drawn from the heating chamber. As shown in FIG. 3, for driving the drawer 2 in the opening/closing direction, the cooker body 1 includes an electric motor (herein after abbreviated as "motor") 6 serving as a drive unit. A pinion 7 attached to the output shaft of the motor 6 is meshed with a rack 5 fixed along the length of the movable rail in the sliding mechanism 4 on the bottom side.

At least one of the sliding mechanisms 4 has a mechanism for actuating a full-closed detection switch or a full-open detection switch when the drawer 2 is moved to the full-closed position or the full-open position, respectively. With regard to full-closed detection, an actuating lever provided at the rearmost position of the movable rail turns on the full-closed detection switch when the drawer 2 is pushed from the opened state to the full-closed position. As shown in FIG. 3, in the passage box, the cooker body 1 is provided with a plurality of detection switches 8 (8*a* to 8*e*), including the full-closed and the full-open detection switch, at a suitable spacing along the drawing direction of the drawer 2. Thus the position of the drawer 2 can be found by actuation of the detection switches 8 disposed at the full-open, intermediate, and full-closed position of the drawer 2, and the opening/closing control of the drawer 2 is based on such positional information about the door 2*a*. While the number of detection switches illustratively used in this example is five, the minimum required number is three in the drawer-type heating cooker according to this invention, and a corresponding example is described later in detail.

When the drawer 2 is drawn out, the actuating lever is disengaged from and turns off the full-closed detection switch. Hence, even during cooking, not to mention after cooking, when the drawer 2 is opened, electric power supply to the microwave generator is turned off, and microwave generation is disabled. The full-closed detection switch can be used as part of the switch for controlling generation and stoppage of microwaves. Actual heating operation of the heating cooker can be specified by user's operation on other control switches. The main switch for starting cooking is separately provided. It is noted that the cooker body 1 (or the door 2*a*) can be provided with a control switch (open/close door controller) 12 for controlling the operation of the heating cooker including the opening/closing operation of the door 2*a*.

Thus the drawer-type heating cooker is configured so that the drawer 2 capable of mounting an object to be heated can be drawn out along with the door 2*a* from the cooker body 1, and that the aperture 10 of the heating chamber can be closed by the door 2*a* in the housed state where the drawer 2 is housed in the heating chamber of the cooker body 1.

In the above drawer-type heating cooker, when a user manually opens/closes the door 2*a*, revolution counting pulses are generated from a pulse generation means associated with the motor 6 despite that no rotation command is issued to the motor 6. Hence, in such situation of pulse generation, by the detection of the revolution counting pulses, it can be determined that the door 2*a* has been manually opened/closed.

At this time, the actuation state of the position detection switches 8 (8*a* to 8*e*) of the door is checked to determine/predict whether the manual operation is more likely to be the opening or the closing operation. On the basis of the determination/prediction, the rotation direction of the motor 6 is controlled to the more likely direction to automatically drive the door 2*a* by the motor 6. Thus the user's burden of opening/closing the door 2*a* can be alleviated.

If the moving direction based on the determination/prediction is opposite to the user's operating direction, the manual opening/closing operation acts in the opposite direction to the opening/closing operation driven by the motor 6, and the motor 6 nearly falls into the lock state. Hence the number of pulses generated by the pulse generation means associated with the motor 6 is different from the number of pulses that is assumed to be normal when the electric motor is rotating in the rotation direction decided by the electric motor control means. By reading it, control is changed to rotate the motor 6 in the reverse direction. By this control sequence, when the user manually opens/closes the door 2*a*, the door 2*a* can be automatically opened/closed in that direction.

Figure 4:
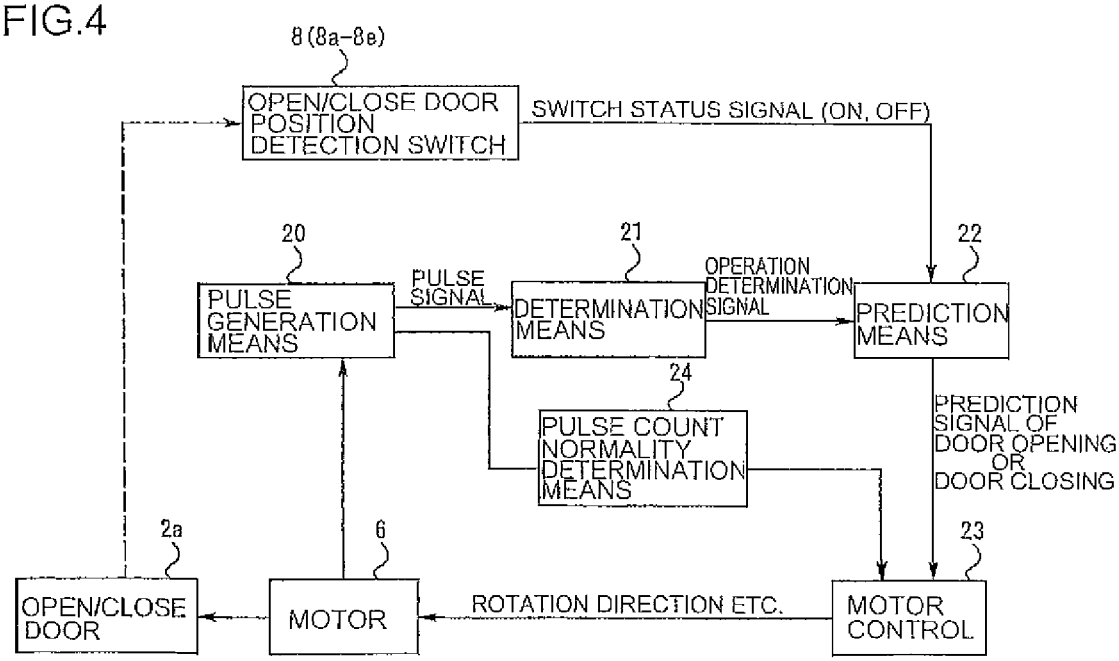
FIG. 4 is a block diagram of the door opening/closing controller of the drawer-type heating cooker according to this invention.

FIG. 4 shows an example block diagram of the open/close door drive controller in the drawer-type heating cooker according to this invention. A pulse generation means 20 is attached to the motor 6 and generates pulses for counting the number of revolutions of the motor 6. When a user manually opens/closes the door, the pulse generation means 20 generates pulses, which are originally intended for revolution counting, despite that no rotation command is issued to the motor 6. On the basis of detection of the pulses generated by the pulse generation means 20, a determination means 21 determines whether the open/close door 2*a* is opened/closed manually or not.

A status signal of the position detection switches 8 for detecting the position of the open/close door 2*a* and an operation determination signal responsive to the determination by the determination means 21 that the open/close door 2*a* is manually operated are inputted to a prediction means 22. On the basis of these signals, the prediction means 22 predicts whether the manual operation of the open/close door 2*a* is the door opening operation or the door closing operation. In accordance with a door operation prediction signal from the prediction means 22, a motor control means 23 decides the rotation direction of the motor 6 and controls the rotation of the motor 6 on the basis of the decision. By this control sequence, when the user manually opens/closes the door 2*a*, a detection is made as to whether the moving direction of the door 2*a* is the opening direction or the closing direction, and in either direction, the door can be automatically opened/closed in that direction.

A pulse count normality determination means 24 is further provided, which determines whether the number of pulses generated by the pulse generation means 20 is normal. In accordance with the status of the position detection switches 8, the pulse count normality determination means 24 determines whether the pulse count is normal. When the pulse count normality determination means 24 determines that the pulse count is normal, the door opening direction or the door closing direction decided by the motor control means 23 is left unchanged. Conversely, when the pulse count normality determination means 24 determines that the pulse count is not normal, it is found that the door opening/closing direction was originally reversed. Hence the motor control means 23 operates the motor 6 in the direction different from the door opening direction or the door closing direction previously decided. More specifically, irrespective of whether the motor control means 23 decides the operating direction of the motor 6 to be the door opening direction or the door closing direction, if the prediction of the door moving direction by the prediction means 22 is wrong, the motor 6 is forced to rotate in the direction opposite to the manual operation and nearly falls into the lock state. Hence the pulses generated by the pulse generation means 20 become not normal. By reading such disturbance in pulse normality, control on the rotation direction of the motor 6 is changed, and the motor 6 can be driven in the same direction as the direction of manual operation.

Figure 6:
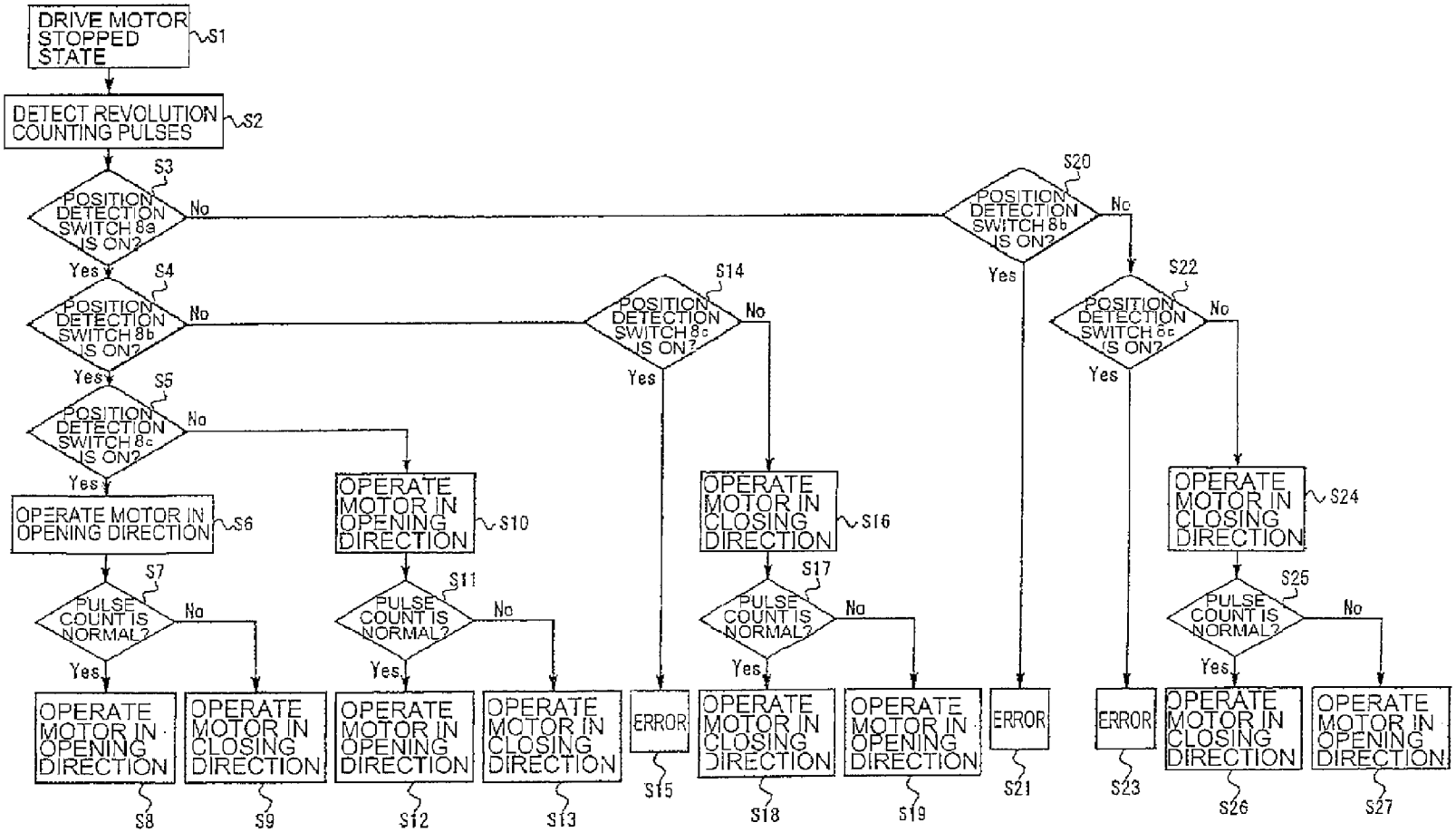
FIG. 6 shows an example flow chart for the door opening/closing controller of the drawer-type heating cooker according to this invention.

FIG. 5 illustrates the correspondence between position detection switches and manual opening/closing operation predictions for the drawer-type heating cooker according to this invention. More specifically, FIG. 5A is a schematic side view of the drawer-type heating cooker having three detection switches in the door full-closed state, FIG. 5B is a schematic side view of the drawer-type heating cooker shown in FIG. 5A in the door full-open state, FIG. 5C is a correspondence table showing the correspondence of manual opening/closing operation predictions based on the status of the position detection switches, and FIG. 5D is a table showing the names of the position detection switches. FIG. 6 is an example flow chart for the door opening/closing control of the drawer-type heating cooker according to this invention. As shown in FIG. 5D, the detection switches 8*a*, 8*b*, and 8*c*, referred to as the door-open switch, intermediate switch, and door-closed switch, respectively, are disposed in this order from the drawer side to the rear side. The following description is given with reference to the correspondence table of FIG. 5C and the flow chart shown in FIG. 6. First, it is assumed that the motor is in the stopped state (step 1, herein after abbreviated as "S1"). Next, the revolution counting pulses generated by the pulse generation means 20 are detected (S2). At this time, it is determined whether the position detection switch 8*a* of the door is ON (S3).

If the determinational S3 is YES, that is, if the position detection switch 8*a* is ON, then it is further determined whether the position detection switch 8*b* of the door is ON (S4). If the determination at S4 is YES, it is further determined whether the position detection switch 8*c* of the door is ON (S5). If the determination at S5 is YES, all the position detection switches 8*a* to 8*c* are ON. Hence, as shown in the leftmost column of FIG. 5C, it is determined that the door is in the full-closed state and about to be opened therefrom, and the motor is operated in the door opening direction (S6). Furthermore, it is determined whether the pulse count is normal (S7). If the determination at S7 is YES, that is, if the pulse count is normal, then the actual opening/closing direction of the door matches the prediction, and hence the motor remains operated in the opening direction (S8). If the determination at S7 is NO, that is, if the pulse count is not normal, then the actual opening/closing direction of the door is contrary to the prediction, and hence the motor is operated in the closing direction (S9).

If the determinational S5 is NO, that is, if the position detection switch 8*c* is not ON (is OFF), then as shown in the second column from the left of FIG. 5C, it is determined that the state of the door is halfway through the opening operation, and the motor is operated in the opening direction (S10). Then steps with the same content as S7 to S9 are performed. More specifically, it is determined whether the pulse count is normal (S11). If the determination at S11 is YES, that is, if the pulse count is normal, then the actual opening/closing direction of the door matches the prediction, and hence the motor is operated in the opening direction (S12). If the determination at S11 is NO, that is, if the pulse count is not normal, then the actual opening/closing direction of the door is contrary to the prediction, and hence the motor is operated in the closing direction (S13).

Likewise, if the determination at S4 is NO, that is, if the position detection switch 8*b* is not ON (is OFF), then as shown in the third column from the left of FIG. 5C, it is determined that the state of the door is halfway through the closing operation. However, in this case, it is checked whether the position detection switch 8*c* is ON (S14). If the position detection switch 8*c* is ON, the set of switch states is in an impossible pattern, and hence is handled as an error (S15). If the determination at S14 is NO, the motor is operated in the closing direction (S16) Then it is determined whether the pulse count is normal (S17). If the determination at S17 is YES, the motor remains operated in the closing direction (S18). If the determination at S17 is NO, the actual opening/closing of the door is contrary to the prediction, and hence the motor is operated in the opening direction (S19).

If the determination at S3 is NO, that is, if the position detection switch 8*a* is not ON (is OFF), then as shown in the rightmost column of FIG. 5C, it is predicted that the door is in the full-open state and in closing operation. In this case, it is checked whether the position detection switch 8*b* is ON (S20). If the position detection switch 8*b* is ON, the set of switch states is in an impossible pattern, and hence is handled as an error (S21). If the position detection switch 8*b* is not ON in the determination at S20, the set of switch states is not in an impossible pattern, and hence it is then checked whether the position detection switch 8*c* is ON (S22). If the position detection switch 8*c* is ON, the set of switch states is in an impossible pattern, and hence is handled as an error (S23).

Furthermore, if the determination at S22 is NO, all the position detection switches 8*a* to 8*c* are OFF. Hence it is determined that the door is in the full-open state and about to be closed therefrom, and the motor is operated in the door closing direction (S24). Furthermore, it is determined whether the pulse count is normal (S25). If the determination at S25 is YES, the motor remains operated in the closing direction (S26). If the determination at S25 is NO, the actual opening/closing direction of the door is contrary to the prediction, and hence the motor is operated in the opening direction (S27).

Figure 7:
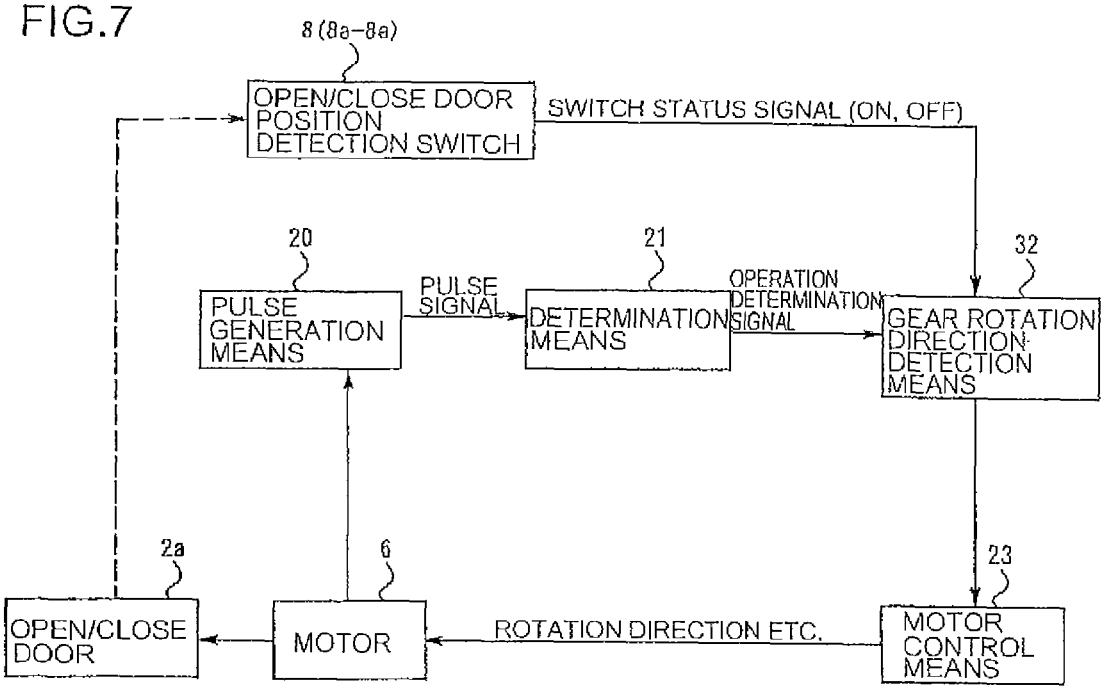
FIG. 7 is another block diagram of the door opening/closing controller of the drawer-type heating cooker according to this invention.

FIG. 7 is another block diagram of the door opening/closing controller of the drawer-type heating cooker. The block diagram of the door opening/closing controller shown in FIG. 7 is different from the block diagram shown in FIG. 4 in that the prediction means 22 is replaced by a gear rotation direction detection means 32. More specifically, this door opening/closing controller does not predict whether the door is in the opening or closing direction, but serves to detect the door opening or closing direction originally intended by the user. When the determination means 21 determines that the open/close door is manually operated, the gear rotation direction detection means 32 detects the rotation direction of a gear (pinion 7 shown in FIG. 3) that transmits the output of the motor 6 to open/close the door 2*a*.

When a user manually opens/closes the door, revolution counting pulses are generated from the motor 6 despite that no rotation command is issued to the motor 6. On the basis of detection of the pulses, it is determined that the door 2*a* is manually opened/closed. Furthermore, when the determination means 21 determines that the door 2*a* is manually operated, the rotation direction of the gear (pinion 7) that transmits the output of the motor 6 to open/close the door 2*a* is detected by the gear rotation direction detection means 32. Thus it is detected whether the manual operating direction of the door is the door opening direction or the door closing direction. In accordance with the detection by the gear rotation direction detection means 32, a motor control means 23 decides the rotation direction of the motor 6 and controls the rotation of the motor 6 on the basis of the decision. By this control sequence, when the user manually opens/closes the door 2*a*, a detection is made as to whether the moving direction of the door 2*a* is the opening direction or the closing direction, and in either direction, the door can be automatically opened/closed in that direction. In contrast to the prediction made by the prediction means 22, the gear rotation direction detection means 32 detects the actual rotation direction of the motor 6. Hence the means for handling wrong predictions, that is, the pulse count normality determination means 24, can be omitted, although it may be used.

Figure 8A:
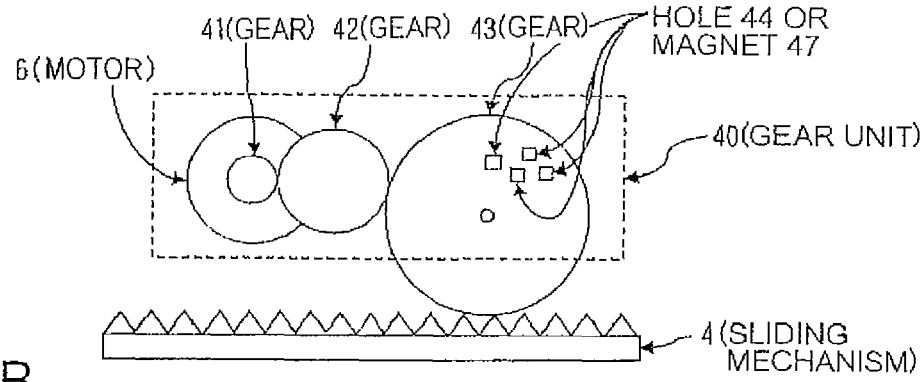
FIG. 8 shows an example of the gear rotation direction detection means used with the door opening/closing controller of the drawer-type heating cooker according to this invention.
Figure 8B:
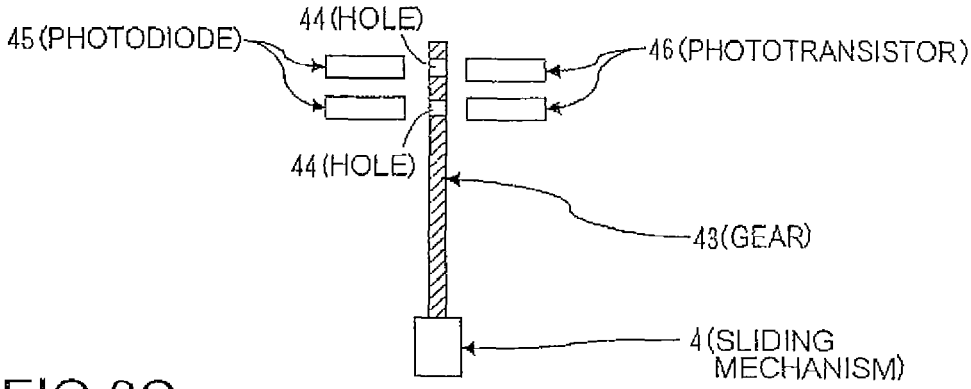
Figure 8C:
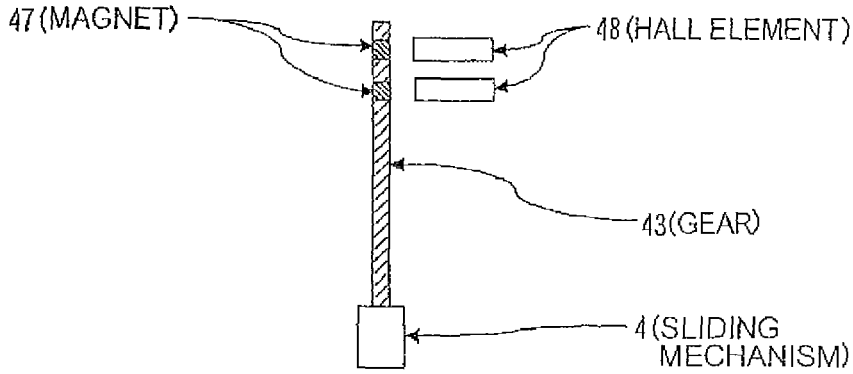

FIG. 8 shows an example of the gear rotation direction detection means. FIG. 8A is a schematic view showing an example including a sliding mechanism (sliding mechanism 4 in FIGS. 2 and 3), a motor 6 for driving it, a gear unit 40 configured as a train of gears for transmitting the output rotation of the motor 6 to the sliding mechanism 4, and a means for detecting the gear rotation direction with reference to a gear 43. The gear unit 40 includes a gear 41 attached to the output shaft of the motor 6, a gear 42 meshed with the gear 41, and a gear 43 meshed with the gear 42 and serving as a pinion meshed with the rack of the sliding mechanism 4. FIG. 8B is a schematic view showing an example of a rotation direction detection means of the optical type, and FIG. 8C is a schematic view showing an example of a rotation direction detection means of the magnetic type. The rotation direction detection means shown in FIG. 8B detects the rotation direction of the gear 43 by using a light receiving element to receive light emitted from a light emitting element and passing through a hole 44 formed in the gear 43. The light emitting element and the light receiving element are disposed to sandwich the gear 43 there between. When a photodiode 45 serving as the light emitting element is opposed through the hole 44 to a phototransistor 46 serving as the light receiving element, light emitted from the photodiode 45 passes through the hole 44 and is incident on the phototransistor 46, and thereby the light is detected. The gear rotation direction detection means of the magnetic type shown in FIG. 8C includes magnets 47 embedded in the gear 43. Above the side face of the gear 43 is disposed a Hall element 48 capable of detecting passage of the magnet 47.

Figure 9A:
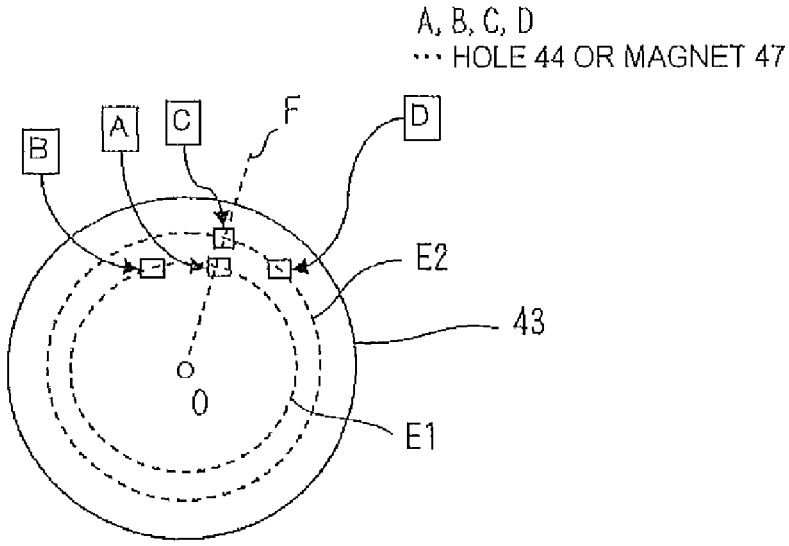
FIG. 9 illustrates a method for detecting the rotation direction of the gear by the rotation direction detection means.
Figure 9B:
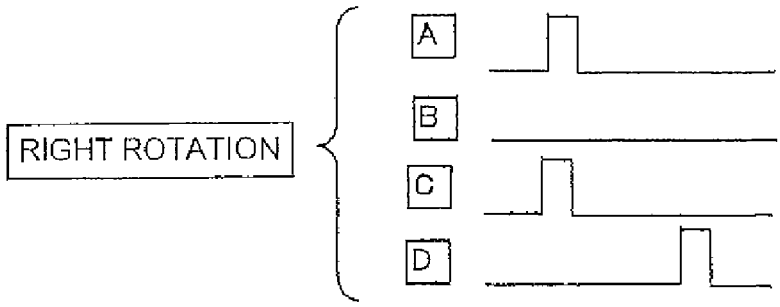
Figure 9C:
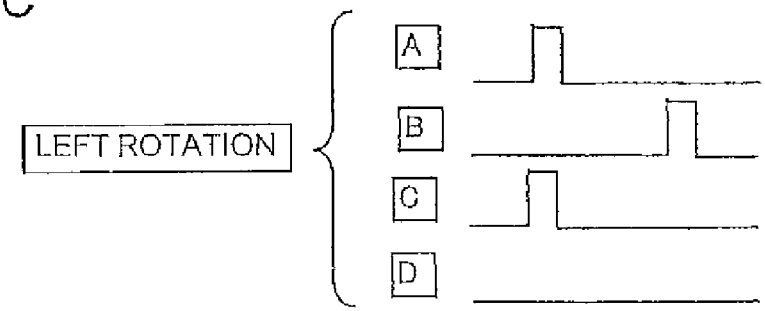

FIG. 9 illustrates a method for detecting the rotation direction of the gear 43 by the rotation direction detection means. FIG. 9A shows a side view of the gear 43 with holes 44 formed or magnets 47 provided therein. In the gear 43, holes/magnets A and B are formed/provided on an identical circle E1 about the rotation center O, and holes/magnets C and D are formed/provided on a circle E2 having a radius different from that of the circle E1 about the same rotation center O. The holes/magnets A and C are disposed on the same radius F. During right rotation of the gear 43, as shown in FIG. 9B, the hole/magnet D is detected earlier, and then the holes/magnets A and C are detected simultaneously. During left rotation of the gear 43, as shown in FIG. 9C, the hole/magnet B is detected earlier, and then the holes/magnets A and C are detected simultaneously. Thus the detection pattern for the holes/magnets A to D depends on the rotation direction of the gear 43. Hence the rotation direction of the gear 43 can be found by detecting this pattern. It is noted that the foregoing means for detecting the rotation direction is illustrative only. Detection means with other configurations can be used by varying the number of holes/magnets and their arrangement, and the number of light receiving elements and Hall elements and their arrangement.

In the above embodiment of the open/close door drive controller, the drive unit is illustratively an electric motor providing rotational output. However, the invention is not limited thereto, but a drive unit for opening/closing the open/close door using an actuating device of the linear motion type such as a linear motor or fluid actuator is also applicable to the drive controller and can likewise assist or substitute for manual opening/closing of the open/close door.

What is claimed is:

1. An open/close door drive controller in a drawer-type heating cooker, the drawer-type heating cooker including a cooker body with a heating chamber formed therein, a drawer that can be drawn out from and housed in the heating chamber and integrally has an open/close door capable of closing an aperture of the heating chamber when the drawer is housed, and a drive unit for driving the drawer, the open/close door drive controller comprising:

determination means for determining whether the open/close door is being manually opened/closed before the drive unit begins driving the drawer; and drive unit control means for controlling the drive unit, wherein in response to determination by the determination means that the open/close door is manually operated, the drive unit control means causes the drive unit to open/close the open/close door in accordance with manual opening/closing direction, wherein the drive unit is an electric motor, the open/close door drive controller further comprising:

pulse generation means for generating pulses for counting the number of revolutions of the electric motor, the pulse generation means being attached to the electric motor, wherein in response to detection of the pulses generated by the pulse generation means, the determination means determines whether the open/close door is manually opened/closed.

2. The open/close door drive controller in a drawer-type heating cooker according to claim 1, wherein the drive unit is driven in a driving direction that is a rotation direction of output rotation of the electric motor, the rotation direction corresponding to the opening/closing direction of the open/close door, and the drive unit control means is electric motor control means for controlling the rotation of the electric motor.

3. The open/close door drive controller in a drawer-type heating cooker according to claim 2, further comprising:

prediction means, responsive to a status of a position detection switch for detecting position of the open/close door, for predicting whether the operation of the open/close door is door opening or door closing, wherein in response to the determination of manual operation by the determination means, the electric motor control means decides the rotation direction of the electric motor in accordance with the prediction by the prediction means and controls the rotation of the electric motor based on the decision.

4. The open/close door drive controller in a drawer-type heating cooker according to claim 3, further comprising:

pulse count normality determination means for determining whether the number of pulses is the number that is assumed to be normal when the electric motor is rotating in the rotation direction decided by the electric motor control means, wherein in response to determination by the pulse count normality determination means that the number of pulses is not normal, the electric motor control means determines that the decided rotation direction of the electric motor does not match the actual rotation direction of the electric motor due to manual opening/closing of the open/close door, redecides the decided rotation direction to be reverse rotation direction, and controls the rotation of the electric motor based on the redecided rotation direction.

5. The open/close door drive controller in a drawer-type heating cooker according to claim 2, further comprising:

gear rotation direction detection means for detecting rotation direction of a gear that transmits the output of the electric motor to open/close the open/close door, wherein in response to the determination of manual operation by the determination means, the electric motor control means decides the rotation direction of the electric motor in accordance with a detection result of the gear rotation direction detection means and controls the rotation of the electric motor based on the decision.

6. The open/close door drive controller in a drawer-type heating cooker according to claim 5, wherein the gear rotation direction detection means includes a magnet embedded in the gear and a Hall element capable of detecting passage of the magnet.

7. The open/close door drive controller in a drawer-type heating cooker according to claim 5, wherein the gear rotation direction detection means includes a photosensor and a light emitting element that are disposed to sandwich the gear there between, and the photosensor can detect light emitted from the light emitting element when the photosensor is opposed to the light emitting element through a hole formed in the gear.

* * * * *